US006108853A

United States Patent [19]

Dittus

[11] Patent Number: 6,108,853

[45] Date of Patent: Aug. 29, 2000

[54] VACUUM CLEANER BEATER BRUSH

[76] Inventor: James D. Dittus, 7635 E. Albany, Mesa, Ariz. 85207

[21] Appl. No.: 09/244,395

[22] Filed: Feb. 4, 1999

[51] Int. Cl.[7] ..... A47L 9/04

[52] U.S. Cl. ..... 15/179; 15/5; 15/141.2; 15/182; 15/366; 15/383

[58] Field of Search ..... 15/5, 41.1, 141.2, 15/179, 181–183, 363, 364, 366, 383

[56] References Cited

U.S. PATENT DOCUMENTS

| | | | |
|---|---|---|---|
| 748,560 | 12/1903 | Reenstierna | 15/41.1 |
| 1,624,247 | 4/1927 | Hoover | 15/179 X |
| 3,716,889 | 2/1973 | Goldstein | 15/179 X |
| 3,758,915 | 9/1973 | Zeski et al. | 15/5 X |
| 5,452,490 | 9/1995 | Brundula et al. | 15/179 X |

*Primary Examiner*—Mark Spisich

[57] ABSTRACT

A vacuum cleaner beater brush for lifting dirt from carpeted surfaces without damaging the carpet's fibers. The vacuum cleaner beater brush includes an elongate roller with a pair of opposite ends, and an outer side surface. Each of the ends of the roller has a mounting stud outwardly extending from the respective end of the roller. The outer side surface of the roller is divided into a pair of generally equal sized regions. The roller has a plurality of resiliently deflectable elongate prongs outwardly extending from a first of the regions of the outer side surface of the roller. The roller has a plurality of resilient bristles outwardly extending from a second of the regions of the outer side surface of the roller.

10 Claims, 2 Drawing Sheets

VACUUM CLEANER BEATER BRUSH

BACKGROUND OF THE INVENTION

1. Field of the Invention

The present invention relates to vacuum cleaner beater brushes and more particularly pertains to a new vacuum cleaner beater brush for lifting dirt from carpeted surfaces without damaging the carpet's fibers.

2. Description of the Prior Art

The use of vacuum cleaner beater brushes is known in the prior art. More specifically, vacuum cleaner beater brushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,167,802 by Pratt et al.; U.S. Pat. No. 3,225,374 by Daley et al.; U.S. Pat. No. 5,014,387 by Hays; U.S. Pat. No. 5,249,328 by Shin; U.S. Pat. No. 4,355,436 by Hertzberg; and U.S. Pat. No. 4,042,997 by McDowell et al.

While these devices fulfill their respective, particular objectives and requirements, the aforementioned patents do not disclose a new vacuum cleaner beater brush. The inventive device includes an elongate roller with a pair of opposite ends, and an outer side surface. Each of the ends of the roller has a mounting stud outwardly extending from the respective end of the roller. The outer side surface of the roller is divided into a pair of generally equal sized regions. The roller has a plurality of resiliently deflectable elongate prongs outwardly extending from a first of the regions of the outer side surface of the roller. The roller has a plurality of resilient bristles outwardly extending from a second of the regions of the outer side surface of the roller.

In these respects, the vacuum cleaner beater brush according to the present invention substantially departs from the conventional concepts and designs of the prior art, and in so doing provides an apparatus primarily developed for the purpose of lifting dirt from carpeted surfaces without damaging the carpet's fibers.

SUMMARY OF THE INVENTION

In view of the foregoing disadvantages inherent in the known types of vacuum cleaner beater brushes now present in the prior art, the present invention provides a new vacuum cleaner beater brush construction wherein the same can be utilized for lifting dirt from carpeted surfaces without damaging the carpet's fibers.

The general purpose of the present invention, which will be described subsequently in greater detail, is to provide a new vacuum cleaner beater brush apparatus and method which has many of the advantages of the vacuum cleaner beater brushes mentioned heretofore and many novel features that result in a new vacuum cleaner beater brush which is not anticipated, rendered obvious, suggested, or even implied by any of the prior art vacuum cleaner beater brushes, either alone or in any combination thereof.

To attain this, the present invention generally comprises an elongate roller with a pair of opposite ends, and an outer side surface. Each of the ends of the roller has a mounting stud outwardly extending from the respective end of the roller. The outer side surface of the roller is divided into a pair of generally equal sized regions. The roller has a plurality of resiliently deflectable elongate prongs outwardly extending from a first of the regions of the outer side surface of the roller. The roller has a plurality of resilient bristles outwardly extending from a second of the regions of the outer side surface of the roller.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vacuum cleaner beater brush apparatus and method which has many of the advantages of the vacuum cleaner beater brushes mentioned heretofore and many novel features that result in a new vacuum cleaner beater brush which is not anticipated, rendered obvious, suggested, or even implied by any of the prior art vacuum cleaner beater brushes, either alone or in any combination thereof.

It is another object of the present invention to provide a new vacuum cleaner beater brush which may be easily and efficiently manufactured and marketed.

It is a further object of the present invention to provide a new vacuum cleaner beater brush which is of a durable and reliable construction.

An even further object of the present invention is to provide a new vacuum cleaner beater brush which is susceptible of a low cost of manufacture with regard to both materials and labor, and which accordingly is then susceptible of low prices of sale to the consuming public, thereby making such vacuum cleaner beater brush economically available to the buying public.

Still yet another object of the present invention is to provide a new vacuum cleaner beater brush which provides in the apparatuses and methods of the prior art some of the advantages thereof, while simultaneously overcoming some of the disadvantages normally associated therewith.

Still another object of the present invention is to provide a new vacuum cleaner beater brush for lifting dirt from carpeted surfaces without damaging the carpet's fibers.

Yet another object of the present invention is to provide a new vacuum cleaner beater brush which includes an elongate roller with a pair of opposite ends, and an outer side surface. Each of the ends of the roller has a mounting stud outwardly extending from the respective end of the roller. The outer side surface of the roller is divided into a pair of generally equal sized regions. The roller has a plurality of resiliently deflectable elongate prongs outwardly extending from a first of the regions of the outer side surface of the roller. The roller has a plurality of resilient bristles outwardly extending from a second of the regions of the outer side surface of the roller.

Still yet another object of the present invention is to provide a new vacuum cleaner beater brush that helps brush dirt into the suction areas of the vacuum.

Even still another object of the present invention is to provide a new vacuum cleaner beater brush that helps brush carpet fibers upwards to keep the nap of the carpet as plush as possible.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
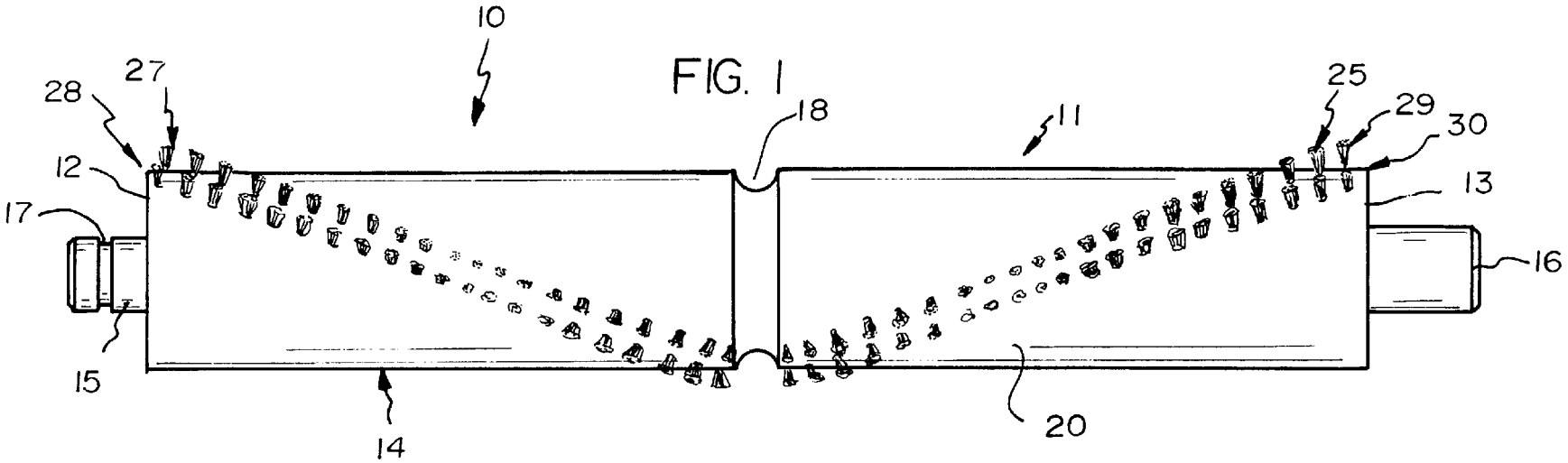
FIG. 1 is a schematic side view of the second region of the outer side surface of the roller of a new vacuum cleaner beater brush according to the present invention.

With reference now to the drawings, and in particular to FIGS. 1 through 4 thereof, a new vacuum cleaner beater brush embodying the principles and concepts of the present invention and generally designated by the reference numeral 10 will be described.

As best illustrated in FIGS. 1 through 4, the vacuum cleaner beater brush 10 generally comprises an elongate roller with a pair of opposite ends, and an outer side surface. Each of the ends of the roller has a mounting stud outwardly extending from the respective end of the roller. The outer side surface of the roller is divided into a pair of generally equal sized regions. The roller has a plurality of resiliently deflectable elongate prongs outwardly extending from a first of the regions of the outer side surface of the roller. The roller has a plurality of resilient bristles outwardly extending from a second of the regions of the outer side surface of the roller.

In closer detail, the beater brush 10 is designed for use in a vacuum cleaner and comprises an elongate generally cylindrical roller 11 having a pair of generally circular opposite ends 12,13, a generally cylindrical outer side surface 14, and a longitudinal axis extending between the ends of the roller.

Each of the ends of the roller has a generally cylindrical mounting stud 15,16 outwardly extending from the respective end of the roller. In use, the mounting studs are designed for rotationally mounting the ends of the roller to a vacuum cleaner. In one idea embodiment, one of the mounting studs has an annular groove 17 therearound. The mounting studs are preferably coaxial with the longitudinal axis of the roller so that the roller is rotatable about the longitudinal axis of the roller.

The roller preferably has an annular channel 18 around the outer side surface of the roller. The annular channel is designed for looping a drive belt from a vacuum cleaner therearound to rotating the roller about the longitudinal axis of the roller. Preferably, the annular channel is located at a midpoint along the roller generally equidistant from the ends of the roller. The annular channel of the roller lies in a plane extending substantially perpendicular to the longitudinal axis of the roller. Preferably, the annular channel of the roller has a generally semi-circular transverse cross section taken in a plane in which the longitudinal axis of the roller lies. The semi-circular transverse cross section of the annular channel has an outwardly facing concavity.

Figure 3:
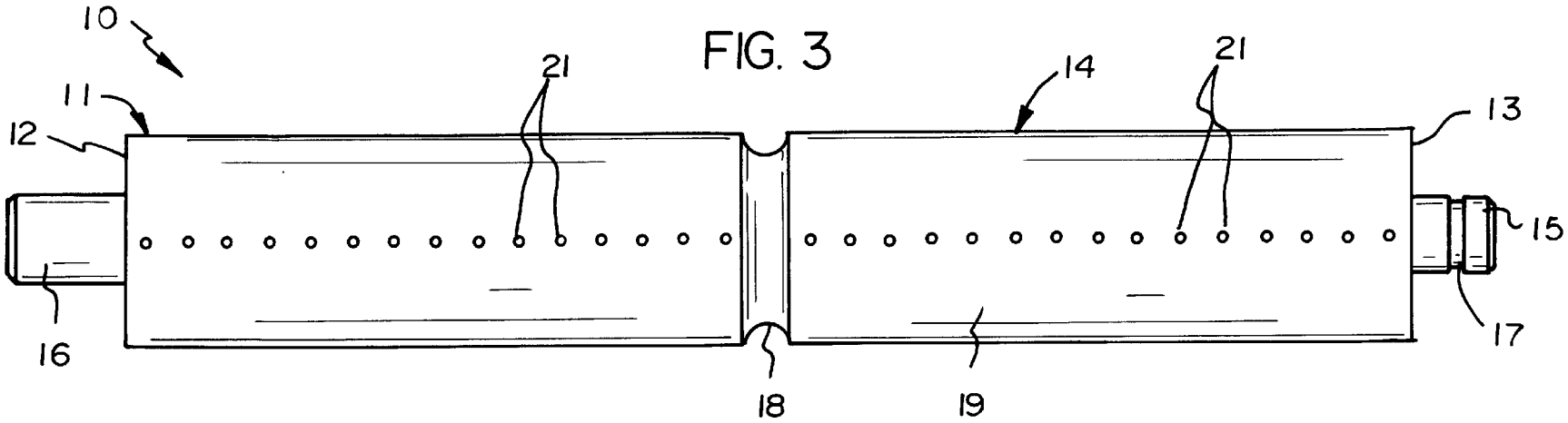
FIG. 3 is a schematic side view of the first region of the outer side surface of the roller of the present invention.

With reference to FIGS. 1 and 3, the outer side surface of the roller is divided into a pair of generally equal sized half regions 19,20. Each of the regions of the roller has a generally semi-circular transverse cross section taken in a plane substantially perpendicular to the longitudinal axis of the roller.

As illustrated in FIG. 3, the roller has a plurality of resiliently deflectable elongate generally cylindrical prongs 21 outwardly extending from a first of the regions of the outer side surface of the roller. The prongs are preferably arranged in a row on the first region of the outer side surface extending between the ends of the roller with the row of prongs and the longitudinal axis of the roller lying in a common plane with one another. Preferably, the prongs are spaced apart in the row at generally equal intervals between the ends of the roller. Ideally, the prongs comprising a resiliently deflectable plastic material.

Figure 4:
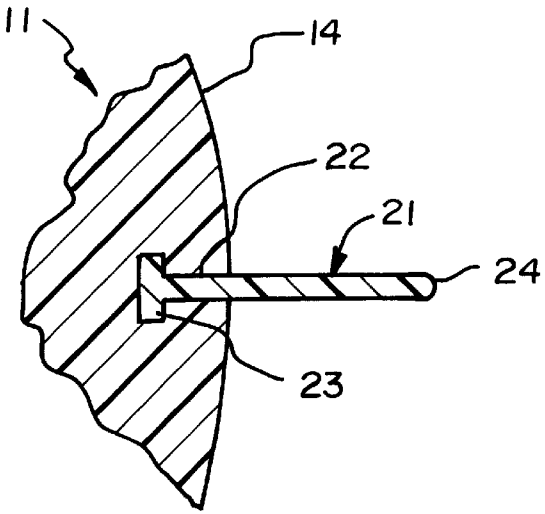
FIG. 4 is a schematic breakaway cross sectional view of a prong of the present invention.

As illustrated in FIG. 4, each of the prongs has a root 22 embedded in the roller. The roots of the prongs each preferably have a generally disk-shaped stop 23 for helping hold the root of the respective prong in the roller. Each of the prongs preferably has a rounded tip 24 opposite the root of the respective prong. The rounded tips are designed for raking through a carpet that the roller is rotated over to loosen dirt from the carpet and to help lift up the nap of the carpet.

Figure 2:
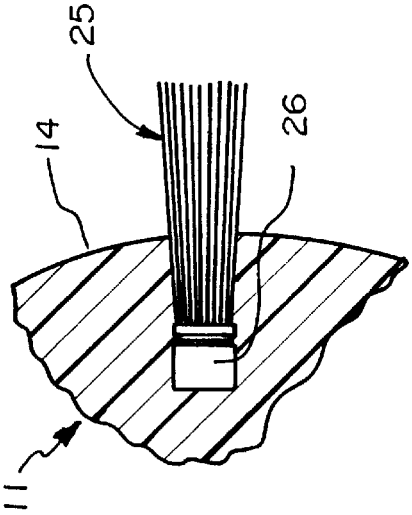
FIG. 2 is a schematic breakaway cross sectional view of a bristle of the present invention.

As illustrated in FIG. 1, the roller also has a plurality of resilient bristles 25 outwardly extending from a second of the regions of the outer side surface of the roller. Each of the bristles has a crimped root 26 embedded in the roller as shown in FIG. 2. The bristles are arranged in a plurality of rows along the second region of the outer side surface. A generally parallel first pair of rows 27,28 of the bristles are extended between a first of the ends of the roller and the annular channel of the roller while a generally parallel second pair of rows 29,30 of the bristles are extended between a second of the ends of the roller and the annular channel of the roller.

The first and second regions have first and second common borders along the outer side surface of the roller which are illustrated in FIGS. 1 and 3 as the top and bottom boundary lines of the respective region. As illustrated in FIG. 1, the first pair of rows of bristles has a first end adjacent the first end of the roller and the first common border and a second end adjacent the annular channel and the second common border. Similarly, the second pair of rows of bristles has a first end adjacent the second end of the roller and the first common border and a second end adjacent the annular channel and the second common border. This way, the first and second pairs of rows of bristles form a generally V-shaped configuration on the second region of the outer side surface of the roller. In use, the rows of bristles are designed for helping brush dirt towards the suction region of the vacuum cleaner.

In an ideal illustrative embodiment, the roller has a length defined between the ends of the roller of about 11 11/16 inches, and a diameter defined perpendicular to the longitudinal axis of the roller of about 3 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beater brush, comprising:

an elongate roller having a pair of opposite ends, an outer side surface, and a longitudinal axis extending between said ends of said roller;

each of said ends of said roller having a mounting stud outwardly extending from the respective end of said roller;

said outer side surface of said roller being divided into a pair of generally equal sized regions;

said roller having a plurality of resiliently deflectable elongate prongs outwardly extending from a first of said regions of said outer side surface of said roller;

said roller having a plurality of resilient bristles outwardly extending from a second of said regions of said outer side surface of said roller;

wherein said roller has an annular channel around said outer side surface of said roller;

wherein said bristles are arranged in a plurality of rows along said second region of said outer side surface; and wherein a generally parallel first pair of rows of said bristles is extended between a first of said ends of said roller and said annular channel of said roller, and wherein a generally parallel second pair of rows of said bristles is extended between a second of said ends of said roller and said annular channel of said roller.

2. The beater brush of claim 1, wherein one of said mounting studs has an annular groove therearound.

3. The beater brush of claim 1, wherein said first and second regions have first and second common borders along said outer side surface of said roller, said first pair of rows of bristles having a first end adjacent said first end of said roller and said first common border and a second end adjacent said annular channel and said second common border, and wherein said second pair of rows of bristles have a first end adjacent said second end of said roller and said first common border and a second end adjacent said annular channel and said second common border such that said first and second pairs of rows of bristles form a generally V-shaped configuration on said second region of said outer side surface of said roller.

4. The beater brush of claim 1, wherein said prongs are arranged in a row on said first region of said outer side surface extending between said ends of said roller, said row of prongs and said longitudinal axis of said roller lying in a common plane with one another.

5. The beater brush of claim 4, wherein said prongs are spaced apart in said row at generally equal intervals.

6. The beater brush of claim 1, wherein each of said prongs has a root embedded in said roller, said roots of said prongs each having a stop located in said roller.

7. The beater brush of claim 1, wherein:

said mounting studs being adapted for rotationally mounting said ends of said roller to a vacuum cleaner;

one of said mounting studs having an annular groove therearound;

said mounting studs being coaxial with said longitudinal axis of said roller;

said annular channel being located at a midpoint along said roller generally equidistant from said ends of said roller;

said annular channel of said roller lying in a plane extending substantially perpendicular to said longitudinal axis of said roller;

said annular channel of said roller having a generally semi-circular transverse cross section taken in a plane in which said longitudinal axis of said roller lies, said semi-circular transverse cross section of said annular channel having an outwardly facing concavity;

each of said regions of said roller having a generally semi-circular transverse cross section taken in a plane substantially perpendicular to said longitudinal axis of said roller;

said prongs being arranged in a row on said first region of said outer side surface extending between said ends of said roller, said row of prongs and said longitudinal axis of said roller lying in a common plane with one another;

said prongs being spaced apart in said row at generally equal intervals;

each of said prongs having a root embedded in said roller, said roots of said prongs each having a generally disk-shaped stop;

each of said prongs having a rounded tip opposite said root of the respective prong;

each of said bristles having a root embedded in said roller;

said first and second regions having first and second common borders along said outer side surface of said roller;

said first pair of rows of bristles having a first end adjacent said first end of said roller and said first common border and a second end adjacent said annular channel and said second common border; and said second pair of rows of bristles having a first end adjacent said second end of said roller and said first common border and a second end adjacent said annular channel and said second common border such that said first and second pairs of rows of bristles form a generally V-shaped configuration on said second region of said outer side surface of said roller.

8. A beater brush, comprising:

an elongate roller having a pair of opposite ends, an outer side surface, and a longitudinal axis extending between said ends of said roller;

each of said ends of said roller having a mounting stud outwardly extending from the respective end of said roller;

said outer side surface of said roller being divided into a pair of generally equal sized regions;

said roller having a plurality of resiliently deflectable elongate prongs outwardly extending from a first of said regions of said outer side surface of said roller;

said roller having a plurality of resilient bristles outwardly extending from a second of said regions of said outer side surface of said roller; and wherein said prongs are arranged in a row on said first region of said outer side surface extending between said ends of said roller, said row of prongs and said longitudinal axis of said roller lying in a common plane with one another.

9. The beater brush of claim 8, wherein said prongs are spaced apart in said row at generally equal intervals.

10. A beater brush, comprising:

an elongate roller having a pair of opposite ends, an outer side surface, and a longitudinal axis extending between said ends of said roller;

each of said ends of said roller having a mounting stud outwardly extending from the respective end of said roller;

said outer side surface of said roller being divided into a pair of generally equal sized regions;

said roller having a plurality of resiliently deflectable elongate prongs outwardly extending from a first of said regions of said outer side surface of said roller;

said roller having a plurality of resilient bristles outwardly extending from a second of said regions of said outer side surface of said roller; and wherein each of said prongs has a root embedded in said roller, said roots of said prongs each having a stop located in said roller.

* * * * *